US005169220A

United States Patent [19]

Herr et al.

[11] Patent Number: 5,169,220

[45] Date of Patent: Dec. 8, 1992

[54] ROTATING SHELF APPARATUS

[76] Inventors: Martin R. Herr, 127 Hill Rd., New Holland, Pa. 17557; David L. Herr, 83 N. Church St., Ephrata, Pa. 17522

[21] Appl. No.: 804,421

[22] Filed: Dec. 10, 1991

[51] Int. Cl.[5] ..... A47F 3/10

[52] U.S. Cl. ..... 312/305; 312/238

[58] Field of Search ..... 312/238, 305

[56] References Cited

U.S. PATENT DOCUMENTS

| | | | |
|---|---|---|---|
| 2,637,613 | 5/1953 | Motter | 312/238 |
| 2,698,776 | 1/1955 | Stoeckl | 312/238 |
| 3,281,197 | 10/1966 | Anderson | 312/238 |
| 4,181,037 | 1/1980 | Boon et al. | 312/238 |
| 4,418,970 | 12/1983 | Hyder et al. | 312/238 |
| 4,433,885 | 2/1984 | Baker | 312/238 |
| 4,440,459 | 4/1984 | Hallgren | 312/238 |
| 4,688,686 | 8/1987 | Mitts et al. | 312/305 |

*Primary Examiner*—Peter R. Crown
*Attorney, Agent, or Firm*—Martin Fruitman

[57] ABSTRACT

Rotating "lazy susan" shelf hardware for the interior of a cabinet. The apparatus uses a cam action to move the door back toward the axis and way from the cabinet edges as rotation begins upon opening, at the same time releasing a detent on the rotational motion of the shelves. As the rotation position approaches the closure position of the door, the door moves gently out toward its closed position, and the door is automatically aligned. This is accomplished with a spring loaded arm on the rotating shelf assembly which carries a roller that follows a stationary circualr cam that has an indentation in it to activate the door's front to back movement. The forward motion of the door caused by the spring action is also slowed by a movement damper.

5 Claims, 2 Drawing Sheets

ROTATING SHELF APPARATUS

SUMMARY OF THE INVENTION

This invention deals generally with supports and cabinet structures, and more specifically with room corner cabinets of the type which include rotating shelves.

Corner cabinets are a familiar structure in modern kitchens, and such corner installations usually include a rotating shelf structure, sometimes referred to as a "lazy susan". These rotating systems are frequently used where counter tops are installed in the corner of a kitchen, because without them, the space under such corner counter tops is virtually inaccessible.

However, unless someone has actually lived with such a rotating shelf arrangement, the drawbacks are not always apparent. In fact, such rotating shelves, with their angled door forming the front of the cabinet structure when the door is closed, are a very effective "finger pincher", which invite painful accidents particularly with little children. Moreover, since this problem is greatly accentuated when the shelves of the rotating assembly are loaded with heavy cans of food which increase the rotating momentum of the assembly, the problem is not fully appreciated before the shelves are installed and loaded. This results in a painful learning process for the users of this type of shelf before the danger is fully appreciated and the habit established of not resting one's fingers on the edges of the rotating door.

While there have been previous designs which attempted to solve this problem of pinched fingers, none of them have been satisfactory, usually because of the complexity of the motion required, but also because their installation usually required a specific cabinet or shelf structure. No previous solution used simple individual circular shelves, required no cabinet modification if they were to be installed on site and still permitted simple adjustment for proper door fit.

The present invention furnishes simple hardware for a rotating shelf and angled door arrangement, which can be installed after the cabinet is completely assembled, and, most important, will not pinch even the smallest fingers.

The present invention solves the mechanical problem by retracting only the door assembly, and thereby reducing the force necessary for the retraction motion, and the door is also maintained in the same horizontal plane, so that gravity need not be overcome upon opening the door or counteracted upon closing. Maintaining the door in the same horizontal plane is possible essentially because the accuracy of the door mechanism is such that it always returns to precisely the same closed location.

These features are accomplished by using an essentially circular cam attached to the inside bottom of the corner cabinet. This cam has a single discontinuity, such as an indentation, in its circumference, so that a cam follower mechanically linked to the door assembly rolls around on the outside circumference of the cam and is affected by the discontinuity only when the door is exactly aligned with the rest of the cabinet front.

In the preferred embodiment, the discontinuity is an indentation, and the cam follower is spring loaded to create a force to move it inward into the indentation, toward the center of the near circular cam. The cam follower is linked to the door by a group of levers so that the door assembly moves radially outward into its closed position only after it is exactly aligned with the cabinet front. Thus, as the door's edges move past the cabinet's front edges, the door is always retracted inward from the cabinet edges and there is no guillotine-like finger pinching mechanism available. In fact, if the shelves are spun rapidly, a favorite sport of some children, the door will not even move into its closed position, so that in this most dangerous situation, there will always be substantial clearance between the moving door edges and the stationary cabinet edges.

This effect of maintaining the door in its retracted position is enhanced by the use of a motion damper which counteracts the spring and only permits the door to move outward in a slow, gentle movement, further assuring that the door will not hurt anyone. Also, the inward indentation of the cam is provided with a gently curved path, so that even without the motion damper the radially outward motion of the door is not forceful.

The design of the cam follower itself also enhances the ease of the door motion and provides for both quiet movement and highly accurate locating of the door. The roller on the cam follower has two different surfaces along the length of its axis.

One surface is covered with a resilient cushion and is located along the axis of the roller in such a manner that it contacts the cam surface during all the travel of the cam follower around the cam, thus providing a smooth, quiet action for travel of the cam follower as the door assembly moves around the axis with the shelves. The second portion of the surface of the roller is axially offset from the cushioned part of the roller and is a hard surface.

To utilize the two different types of surface on the roller, the indentation in the cam is constructed so that it contacts only the hard surface of the cam roller while the cushioned portion of the roller makes no contact with the indentation. This arrangement permits the roller to be very accurately located when in contact with the indentation of the cam, and therefore accurately determines the location of the angled door when it is closed, while still permitting the quiet cushioned action of the cam and roller at other times.

The combination of the indented cam with gentle slope, the cushioned roller, and the motion damper counteracting the force of the spring permits the door retraction motion to be so quiet and so subtle that, without close examination, it is difficult to see that the door actually moves back from the cabinet edges before rotation begins. Nevertheless, if one's fingers are left on the cabinet edge, the absence of pain when the door rotates around to the front makes it quite clear that the mechanism is working, and doing its job quite well.

Furthermore, the simple mechanism of the invention permits it to be constructed with very little height, and it can therefore be located entirely below the bottom shelf of the rotating structure and use up no significant storage space.

DETAILED DESCRIPTION OF THE INVENTION

Figure 1:
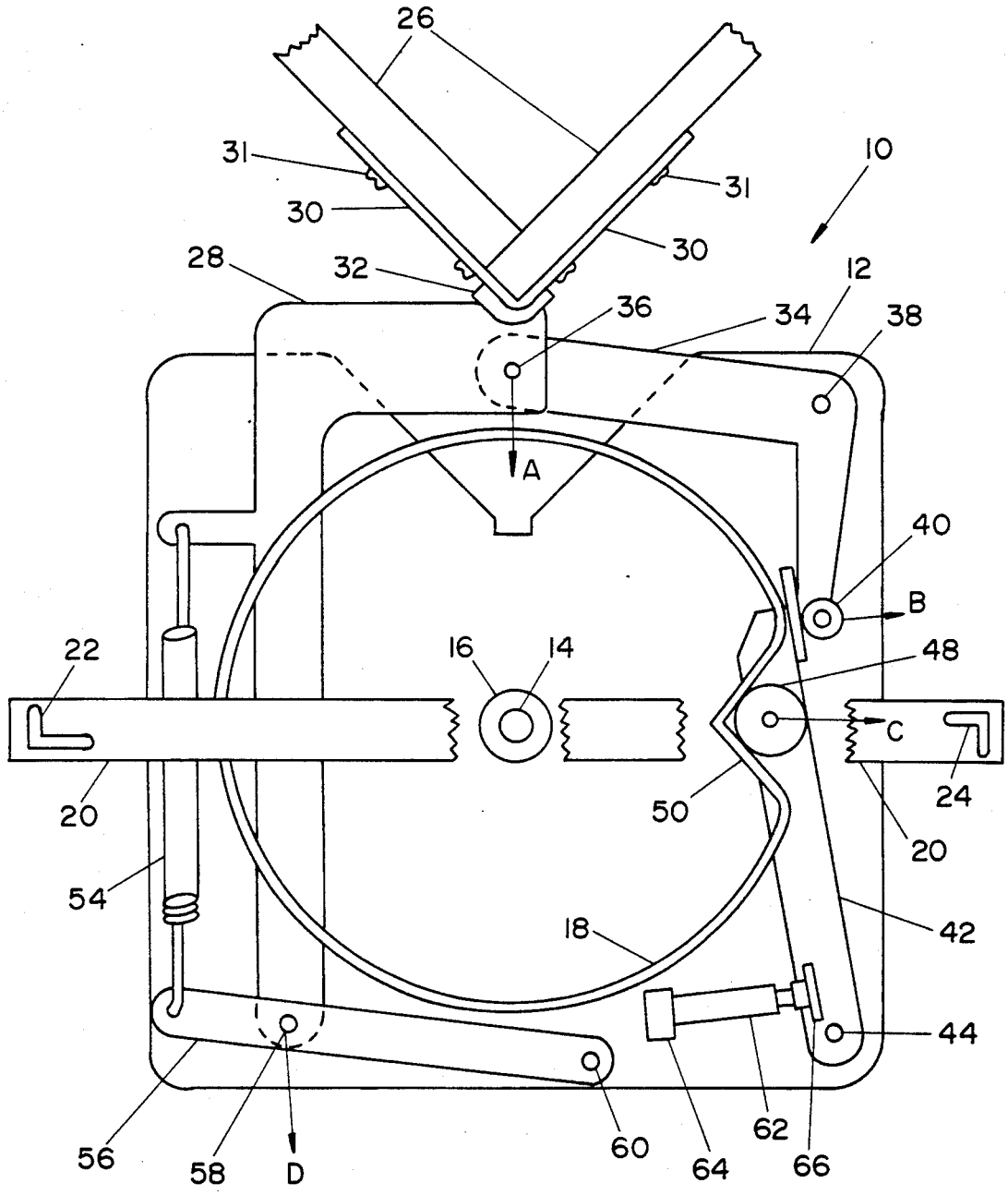
FIG. 1 is a bottom plan view of the preferred embodiment of the invention.

The preferred embodiment of the invention is shown in FIG. 1 which is a view of the mechanism of the invention from directly below the structure as it would be when installed on the bottom of a cabinet. In FIG. 1 rotating shelf apparatus 10 is mostly assembled upon support plate 12. Bearing 16, located at the approximate center of plate 12, connects plate 12 with axis 14 which extends upward (into the paper) into the cabinet within which rotating shelf apparatus 10 is installed. Plate 12 and most of the other components of rotating shelf apparatus 10 rotate around axis 14 as a unit.

Plate 12 is one of several shelf supports attached to rotating shelf apparatus 10 along axis 14 in order to permit the attachment of circular shelves (not shown) to support stored items. The additional shelf supports (not shown), other than plate 12, are attached to plate 12 by conventional methods such as by a leg welded to plate 12 and extending parallel to axis 14. However, the specific means for attachment of additional shelves is not a part of this invention.

One part of rotating shelf apparatus 10 which is not mounted upon plate 12 is cam 18 which is attached to the bottom of the cabinet within which apparatus 10 is installed. Cam 18 is attached to the bottom surface of such a cabinet by means of strap 20 which is attached to cam 18, and axis 14 is also attached to strap 20. Strap 20, only segments of which are shown in order to better view the other components, is attached to the cabinet bottom surface by the use of screws (not shown) through slots 22 and 24. Slots 22 and 24 are formed with multiple legs to permit the adjustment of the location of axis 14 and cam 18 within the cabinet in order to align door 26 with the front of the cabinet. As will be appreciated from the following description, the location of axis 14 determines the closed position of corner door 26, which is intended to align with the front of the cabinet within which apparatus 10 is installed. In FIG. 1, door 26 is shown in its closed position, that is, in its position which is most distant from axis 14.

Door 26 is attached to plate 12 by two pivoting arms so that door 26 can rotate with plate 12, but door 26 can also move toward and away from axis 14 on an approximate radial path. Door 26 is attached to arm 28 by being attached to angle plate 30 with screws 31. Angle plate 30 is welded to arm 28 at corner 32. The portion of arm 28 to which door 26 is attached moves closer to axis 14, on path A, as arm 34, attached to arm 28 at pivot point 36, pivots on pivot point 38 when roller 40, on the other end of arm 34, moves outward on path B.

The motion of roller 40 outward on path B is caused by arm 42 moving outward as it pivots on pivot point 44, and this movement is caused by cam follower roller 48 on arm 42 being forced outward on path C by cam 18 as plate 12 rotates relative to cam 18. Regardless of the direction of rotation of plate 12, cam follower roller 48 will move out of the discontinuity in cam 18, indentation 50, and therefore door 26, which is mechanically linked to cam follower 48, will move inward toward axis 14.

The outward motion of roller 48 on path C is counteracted by the action of spring 54 which acts against the motion of arm 56 and pivot point 58 rotating in the direction of arrow D on pivot point 60. Since pivot point 58 moves with arm 28 to which door 26 is attached, pivot point 58 moves in direction D when cam follower roller 48 moves outward out of indentation 50 in direction C and door 26 moves inward toward axis 14 in direction A. However, movement of arm 56 in direction D also stretches spring 54, so that when cam follower roller 48 is opposite indentation 50, and not held outward by the surface of cam 18, spring 54 causes cam follower roller 48 to move inward, opposite to arrow C, and door 26 moves outward opposite to direction A. Thus, by means of spring 54, cam follower 48 is made to be constantly urged inward unless prevented by the shape of cam 18, and therefore door 26 similarly is held in toward axis 14 when plate 12 rotates into any position other than when cam follower roller 48 is within indentation 50.

The shape and slope of indentation 50 in cam 14 can be chosen to make the apparatus and motion described above quite satisfactory to accomplish the purpose of the invention to assure that door 26 always retracts when rotation is initiated and that door 26 stays retracted until it is exactly aligned for closure. However, it has been found that the safety of the apparatus can be further enhanced by slowing the outward movement of door 26 by means other than a gradual slope of indentation 50, so that even when aligned properly, the door does not move out with any significant force. This feature is attained by the addition of a damper to slow the movement.

As seen in FIG. 1, conventional hydraulic damper 62 is attached to plate 12 at adapter 64 and also attached to arm 42 at attachment point 66. Thus, the motion of arm 42 and cam follower 48 inward and the motion of door 26 outward is changed to a gentle, yet forceful, motion, and prevented from being at all violent. It is virtually impossible for anyone's fingers to be pinched, because damper 62 assures that there will always be clearance between the door and cabinet edges as the door moves past the cabinet edge and that, therefore, there will be no slicing motion and the door will simply move gently radially outward after it has cleared the cabinet edges.

Figure 2:
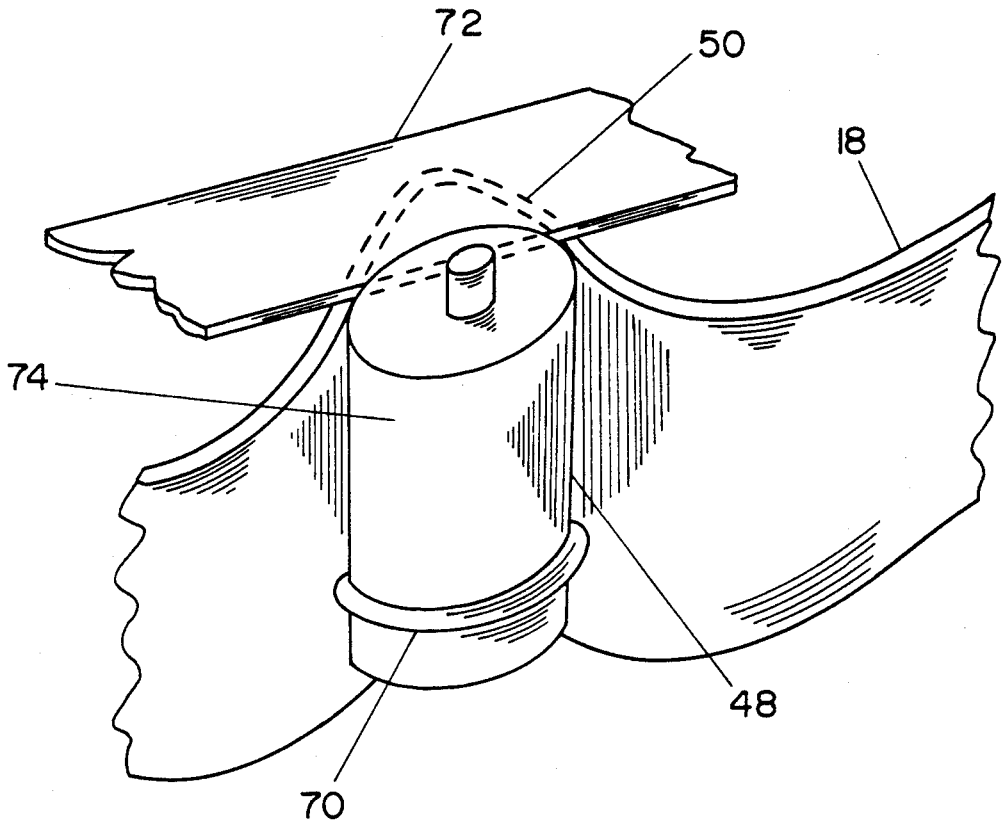
FIG. 2 is a perspective view of a cam follower and a portion of the discontinuity of the cam which determines the closed position of the cabinet door.

FIG. 2 depicts another feature of the invention which makes the rotation of the rotating shelf apparatus smoother and quieter, but also assures accurate alignment of the door in the closed position. Cam follower roller 48 can actually be constructed with two different surfaces, one cushioned surface which encourages quiet movement along cam 18, and another hard surface which assures accurate location when cam follower roller is located within cam indentation 50. At the same time, indentation 50 can be formed so that when cam follower roller 48 is at rest within indentation 50, only the hard surface of cam follower roller 48 which is selected for accuracy is in contact with indentation 50.

As can be seen in FIG. 2, the preferred embodiment of the invention accomplishes this distinction between the two types of surfaces by placing the two different surfaces at different locations along the axis of cam follower roller 48. The cushioned surface is attained quite simply by attaching conventional "O" ring 70 around the circumference of roller 48. The thickness of "O" ring 70 assures that "O" ring 70 is the only portion of roller 48 which contacts cam 18 as roller 48 moves around cam 18 outside of indentation 50.

However, when cam roller 48 is within indentation 50, as shown in FIG. 2, plate 72, which is attached to indentation 50, determines the rest position of roller 48 because the hard surface 74 of roller 48 contacts plate 72 before "O" ring 70 lodges within indentation 50. The position of roller 48 within indentation 59 is therefore controlled by two unyielding surfaces, plate 72 and roller surface 74, and the position is determined with greater accuracy than would be the case if it where determined by "O" ring 70 which is compressible. Such an arrangement permits the fit of the door and the cabinet front edges to be very accurate.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the exact configuration shown for the various pivoting arms could be modified.

What is claimed as new and for which Letters patent of the United States are desired to be secured is:

1. An apparatus for rotating shelves and retracting a door rotating with the shelves, comprising:

a cam attached to a base, the cam having a cam surface with a discontinuity at one location on the surface and the cam surface determining a plane;

a plate rotatable on an axis, the axis being located within an area enclosed by the cam surface, and being perpendicular to the plane of the cam surface;

an arm attached to the plate at a pivot point so that the arm pivots in a path approximately parallel to the plane of the cam surface, with the path of a first end of the arm moving approximately on a line which extends through the axis and the cam surface;

a cam follower held in contact with the cam and acting upon a second end of the arm in a manner so that, as the cam follower follows the discontinuity on the cam surface, the first end of the arm moves away from the axis;

a force applying means interconnected with the cam follower so that the force applying means maintains the cam follower in contact with the cam surface as the plate rotates and causes the cam follower to follow the discontinuity on the cam surface when the cam follower is aligned with the discontinuity;

shelf supporting means attached to the plate; and a door interconnected with the first end of the arm.

2. The apparatus of claim 1 further including a motion damper interconnected with the cam follower and acting to control the movement of the cam follower as the cam follower follows the discontinuity on the cam surface.

3. The apparatus of claim 2 wherein the motion damper is a hydraulic damper which slows the motion of the cam follower.

4. The apparatus of claim 1 wherein the cam follower has two different surfaces, one surface providing a cushioning action as the cam follower moves around the cam surface, and the second surface providing a hard surface to accurately position the cam follower when it is at the discontinuity on the cam surface.

5. The apparatus of claim 1 further including adjustment means to vary the location of the axis of the rotatable plate relative to the base.

* * * * *